United States Patent [19]

Conville

[11] Patent Number: 4,961,586

[45] Date of Patent: Oct. 9, 1990

[54] BAG TOSSING GAME

[75] Inventor: David J. Conville, Hot Springs, Ark.

[73] Assignees: Conlab, Inc., Hot Springs; Nancy Carver, Little Rock, both of Ark.

[21] Appl. No.: 479,976

[22] Filed: Feb. 14, 1990

[51] Int. Cl.[5] ..... A63B 63/00; A63B 67/00

[52] U.S. Cl. ..... 273/402

[58] Field of Search ..... 273/401, 402, 415, 398, 273/400

[56] References Cited

U.S. PATENT DOCUMENTS

| | | | |
|---|---|---|---|
| D. 252,047 | 6/1979 | Cirrone | D21/1 |
| 285,396 | 9/1883 | De Windt | 273/402 X |
| 922,717 | 5/1909 | Parker | 273/401 |
| 2,021,989 | 11/1935 | DeMaster | 273/105 |
| 2,291,104 | 7/1942 | Radzyner | 434/261 |
| 3,480,280 | 11/1969 | Gamertsfelder | 273/106 |
| 3,554,550 | 1/1971 | Schram | 273/95 |
| 3,628,793 | 12/1971 | Mudloff | 273/105 R |
| 3,837,650 | 9/1974 | Haney | 273/105 R |
| 3,837,653 | 9/1974 | Fox et al. | 273/178 R |
| 4,116,443 | 9/1978 | Dorfman | 273/95 R |
| 4,186,925 | 2/1980 | Goldfarb et al. | 273/389 |
| 4,243,229 | 1/1981 | Huser et al. | 273/402 |
| 4,565,375 | 1/1986 | Dresel | 273/401 |
| 4,709,929 | 12/1987 | Mills | 273/402 |

*Primary Examiner*—William H. Grieb

*Attorney, Agent, or Firm*—Stephen D. Carver

[57] ABSTRACT

A molded plastic, bag tossing game for use by one or more players can be disposed in either a transportable mode, a display mode, or a playing mode. In the playing mode a pair of identical, modular target assemblies are deployed in spaced apart relationship to present a pair of slightly inclined, apertured targets towards which soft bags are thrown to generate points in accordance with rules. Each target assemby comprises a resilient, molded plastic playing board of generally rectangular configuration, which includes an upper, elevated target aperture. Each target board comprises a removable, modularized elevator tray which can be snap fitted to the boards to gently incline them for play. The trays also prevent bags dropping through the target hole from escaping the board underside. The tray leading edge is inclined. A brace extending from the board underside reinforces the trays during play. For storage each elevator tray can be flatly snapped into position on the underside of the target board captivating the bags, and securing the brace to prevent rattling noises. Integral, outwardly projecting legs defined on one board end penetrate suitable sockets defined on an opposite board end to enable coupling. The boards may be frictionally fitted together assuming the transportable mode while maintaining a sleek, overall low profile. Recessed notches defined in each playing board function as carrying handles. Suitable advertising or display indicia may be displayed upon the smooth target surface.

31 Claims, 4 Drawing Sheets

BAG TOSSING GAME

BACKGROUND OF THE INVENTION

The present invention relates generally to projectile tossing games involving one or more players. More particularly, the present invention relates to a bag tossing game involving apertured, slightly inclined targets which double as a display devices for advertising logos and the like.

In the prior art a variety of tossing games including a number of different projectiles and missiles have been proposed. Previous tossing games have involved a plurality of projectiles, such as metallic darts, golf balls, softballs, baseballs, footballs and the like. The prior art also reflects generally inclined, target devices having an apertured front surface which act as targets for associated projectiles.

The concept of providing a tossing game with apertured, inclined planes which function as targets was disclosed in U.S. Pat. No. 2,021,989, issued Nov. 26, 1935. The latter reference discloses an inclined plane having an aperture functioning as a target. When balls are tossed by a player towards the target, they may be collected within a captivated collection pocket if they penetrate the target orifice.

The most relevant prior art know to me comprises U.S. Pat. No. 3,628,793, issued Dec. 21, 1971, and entitled Sandbag and Target apparatus. In that device a pair of fixed, wedge shaped half sections, each including an apertured and inclined plane functioning as a target, may be deployed separately in a tossing game configuration, or they may be clamped together when desired to transport the device. Preferably bags are tossed towards the each target, and various points may be scored by the players. Scoring, for example, may take place when bags penetrate the central orifice, or remain on the target surface after a round. Both of the target half sections are relatively cumbersome and heavy, making convenient transportation and deployment difficult. In addition, when the two target wedges are clamped together, the net volume of the coupled unit is approximately twice that of either wedge unit alone.

U.S. Pat. No. 4,709,929 issued Dec. 1, 1987 is also relevant. It discloses a pair of apertured game boards which can be deployed in an inclined playing mode, and which can be coupled together for transportation. Haney U.S. Pat. No. 3,837,650, issued Sept. 24, 1974 discloses a bag tossing target device having a pair of hingedly connected panels which can be deployed in an inclined plane target mode. An aperture in the target surface is provided for receiving a bag, and the game contemplates scoring by penetrating the orifice. Similar devices are seen in U.S. Pat. Nos. 2,291,104, issued July 28, 1942, 4,223,229 issued Jan. 6, 1981, and 4,565,375, issued Jan. 21, 1986, all of which disclose target boards having an orifice. Fox U.S. Pat. No. 3,837,653 issued Sept. 24, 1974, comprises a game in which a slightly inclined plane forms a target for a golf ball.

Other less relevant tossing games involving bags or the like can be seen in U.S. Pat. Nos. 3,554,550; 4,186,925; 4,116,443; and Des. Pat. No. 252,047. U.S. Pat. No. 3,480,280, issued Nov. 25, 1969 discloses a bean bag design for a projectile suitable for use in bag tossing games.

However, none of the prior art known to me provides a suitable bag toss game device in which individual ultra-lightweight components may be easily snapped together for suitable use, and which may be unsnapped and fitted together prior to convenient transportation. None of the devices proposed heretofore have disclosed a plurality of interfitting plastic parts which when properly snap fitted together, enable the game to be quickly deployed in either transportable, display, or playing modes. None of the other known devices provides a target hole site which ideally incorporates advertising. None combines an ideal bag storage device in a modularized embodiment.

SUMMARY OF THE INVENTION

My invention comprises a tossing game for use by one or more players which can be conveniently disposed in either a low profile transportable position, which also functions as a display position, or a playing position in which a pair of identical modular target assemblies are first separated from one another and then deployed.

Each target assembly is of similar configuration, preferably comprising a resilient, molded plastic playing board of generally rectangular configuration, which includes an upper elevated target aperture towards which soft objects such as beanbags are aimed by players. Means are provided for quickly switching the game apparatus between desired orientations. For example, the playing boards can be coupled together for storage or transportation in a flat, low profile configuration not unlike a small suitcase. Recessed notches defined in each playing board can be used as handles to conveniently carry the apparatus. The individual target modules can then be separated for erection in a playing mode in which both assume a right triangular orientation.

Each target board preferably comprises integral outwardly projecting legs on one end and cooperating sockets defined on an opposite end. The legs from one board may frictionally penetrate the sockets formed in the opposite end of the companion board so that a pair of playing boards may be coupled together. When so disposed, a uniform, generally low profile results, and the game is generally in the form of a parallelipiped. It is low in profile, since its net thickness in the storage or transportation mode is less than the maximum height of the target board when deployed in the playing mode.

Each target board comprises a modularized elevator tray which, in the storage mode captivates and conveniently stores the bags. In the playing mode, the elevator trays dispose the target in an inclined orientation with a fifteen degree slope, and they prevent bags dropping through the target hole from escaping the board underside. Each elevator tray can be flatly snapped into position on the underside of a playing board captivating the toss bags. When so disposed, the boards may be frictionally fitted together into the transportable mode while maintaining a sleek, low profile.

When the game is to be played, each target assembly is set up properly and spaced apart from one another to present suitable inclined planes towards which a plurality of bean bags are thrown during the playing of the game. Each target assembly comprises an external target surface near the top of which the aperture extends. Suitable advertising or display indicia may be displayed upon the target surface. Each playing board is propped in the inclined position by the associated elevator tray, which comprises a generally rectangular piece adapted to be snap-fitted to the playing board. In the playing mode the elevator tray is snap-fitted to the end of a playing board to maintain it in an inclined position. It is mechanically fortified by a rigid brace extending between the playing board and the base of the elevator tray. Because of the unique elevator tray configuration, the brace may be sized no longer than the length of the playing board, and yet swivel out of the board to engage the elevator tray and complete the triangle.

The inner surface of the playing board comprises a unique snap-fit tab system for receiving the leading, inclined edge of the elevator tray which is wedged into the board for a secure fit. Because the leading end of the elevator tray is inclined, its base is thus positioned according to well known geometric relationships "closer" to the brace system, so that the brace, which also fits within the playing board underside during storage, will be long enough to reach the elevator tray. Preferably the elevator trays also store the bean bags within the underside of each playing board when they are snap-fitted to suitable reinforcement ridges and other structure disposed thereunder.

Because of the unique geometry disclosed, the length of the elevator tray (i.e. the length which one end of the playing board is elevated above ground when inclined . . . ) is greater than the overall thickness of the unit when in a storage mode. Thus the elevator tray length is greater than twice the thickness of the playing boards. Hence a low profile is maintained. Further, ease of storage is facilitated by the fact that the preferred brace can be completely stored within the playing board.

Thus a primary object of the present invention is to provide a safe and convenient modular tossing game suitable for enjoyable use by adults and children.

A fundamental object is to provide a safe, user-friendly tossing game which is both easy-to-learn and competitive.

A similar object is to provide a tossing game designed to challenge and refine the skills of all players, including experts, novices, women, or children.

Another object is to provide an ultra-light weight game of the character described which may be quickly and easily switched between transportable and playing orientations.

Still another object is to provide a game of the character described which, in each of its many modes, provides an attractive user perceptible display upon which advertising indicia, product logos, or the like may be advantageously deployed.

A related object is to provide a game of the character described in which the target playing surface is as smooth and unobstructed as possible, to enhance the efficacy of product advertising displayed on the board.

A still further object of the present invention is to provide a game of the character described which is constructed of preformed, washable plastic materials suitable for the display of commercial advertising.

Another important object of the present invention is to provide a bag tossing game of the character described which can assume a low profile for ease of storage and transportation.

Another object of the present invention is to provide a modularized tossing game of the character described equipped with pairs of identical cooperating parts to minimize the number of necessary plastic injection molds.

Stated another way, it is a fundamental object of the present invention is to provide a toss game of the character described, the production of which requires only a minimum amount of molding and tooling. It is a feature of the present game that identical inter-fitting, inclined planes can be snap fitted together to provide a convenient transportation mode.

Yet another object of the present invention is to provide a game of the character described, whose parts are firmly nested together during transportation to prevent rattling or other unwanted or suspicious noises.

Another fundamental object of the present invention is to provide a tossing game of the character described which cannot injure anyone.

Another object is to provide a commercially practical game of the character described which can replace admittedly popular, but unfortunately dangerous tossing games involving darts.

Another object of the present invention is to provide a bag toss game of the character described which is ideal for the display advertisement for unrelated goods and services. It is a feature of the invention that appropriate advertising logos can be prominently displayed in such a manner as to be plainly visible when the game is stored, transported, or played.

Yet another fundamental object of the present invention is to provide a bag toss game of the character described in which both inclined plane targets are modularized and compartmentalized so that they can be folded together into one unitary carrying piece, with the bags and other parts firmly secured therewithin.

Another object is to provide a toss type game using a maximum of subtleties designed to continuously challenge the most seasoned player. For example, subtle features of the invention comprise unique target aperture placement and board slope, and material friction coefficients.

An additional object is to provide a game of the character described in which initial, potentially scoring shots can be canceled or nullified by succeeding shots. Because of board material thickness or density, shots initially likely to register scoring points are likely to be canceled or rejected during the subsequent play of successive bags.

Another object is to provide a completely safe toss type game using soft, harmless bags.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
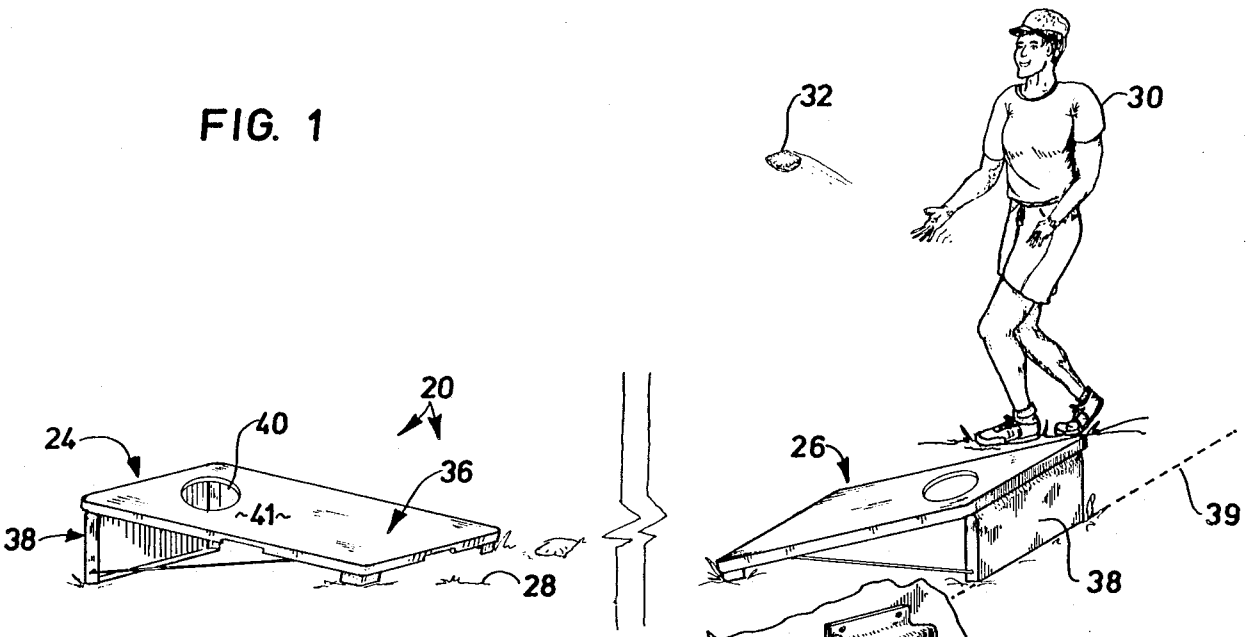
FIG. 1 is a diagrammatic perspective view showing my game disposed in the playing mode.
Figure 3:
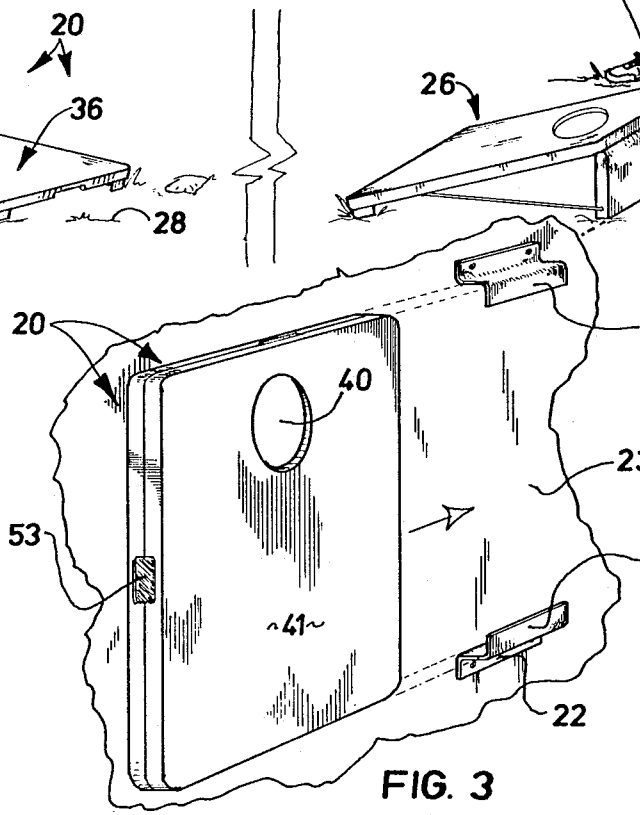
FIG. 3 is a fragmentary isometric view illustrating the game disposed in the display and storage mode.
Figure 2:
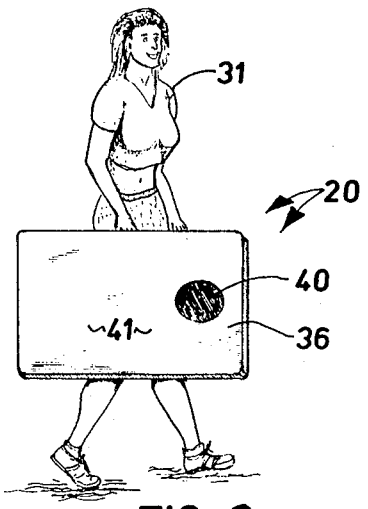
FIG. 2 is a pictorial view of a typical user carrying the game in its transportable mode.

With initial reference directed to FIGS. 1–3 of the appended drawings, my portable tossing game has been generally designated by the reference numeral 20. FIG. 1 illustrates my game deployed in the "playing mode." FIG. 2 illustrates how the game is disposed in its "transportable" mode and FIG. 3 illustrates the game disposed in a "display" mode. In the display mode the game is mechanically configured the same as the transportable mode, but it is oriented generally vertically instead of horizontally, and it is typically disposed upon a wall or other flat, upright surface or structure. As used hereinafter, the terms "display mode" and "transportable mode" will be referred to interchangeably.

In the playing mode a pair of identical target assemblies 24, 26 are first placed upon the ground 28 in spaced relation approximately ten or more adult paces apart. One or more players 30, 31 may then toss bag projectiles 32 towards the inclined target assembles. The bags are preferably filled with pop-corn, and they weigh approximately eight ounces. Thus they are light enough to avoid injury, but heavy enough to be relatively unaffected by modest cross winds during play. It is preferred that the bags be made from lightweight denim, which can be silk screened with an appropriate logo. Points are awarded to players or teams of players in accordance with rules discussed hereinafter, when bags either penetrate the target orifices 40, or otherwise remain on the board after a round.

The target assemblies are identical, comprising a generally rectangular playing board 36 adapted to be disposed in the playing mode in an inclined fashion, and an associated elevator tray 38 which maintains the playing board in an inclined position. Aperture 40 is defined through the playing board and it forms a target for bean bags 32. The outer face 41 of the playing board suitable for receiving and displaying a company logo or product illustration or the like. As will be explained hereinafter, the target assemblies 24 and 26 may be collapsed and then coupled together to dispose the game 20 in the transportable mode so that player 31 may conveniently transport the apparatus as desired. In the display mode shown FIG. 3, the game may be flatly disposed upon a suitable surface such as wall 23 in a generally vertical orientation, being held by a pair of identical angle brackets 21 whose feet 22 are secured to wall 23.

Turning now to FIGS. 4–9, since the target assemblies are identical, the components of each individual target assembly will be assigned a single reference numeral, and different portions thereof will be referred to interchangeably in the various views and accompanying discussion. Each target assembly primarily comprises a resilient playing board, generally designated by the reference numeral 36, and a companion elevator tray 38. As will be appreciated from a comparison of the various drawings, the elevator tray 38 may be nested within the underside of the playing board when the game is to be disposed in either the transportable or the display position, or it may be snap-fitted as in FIG. 9 to dispose the playing board in an inclined, generally right triangular playing orientation.

Each playing board is generally rectangular, and is preferably molded from high density polystyrene. Playing board 36 comprises a smooth outer, planar surface 41, which is adapted to receive a silk screen company logo or the like. The opposite interior surface 51 comprises the underside of the playing board. The external surface 41 functions as a target surface towards which bags or projectiles 32 are thrown during playing. The width to length ratio of surfaces 41 and/or 51 (and thus the board) is preferably two to three.

Figure 6:
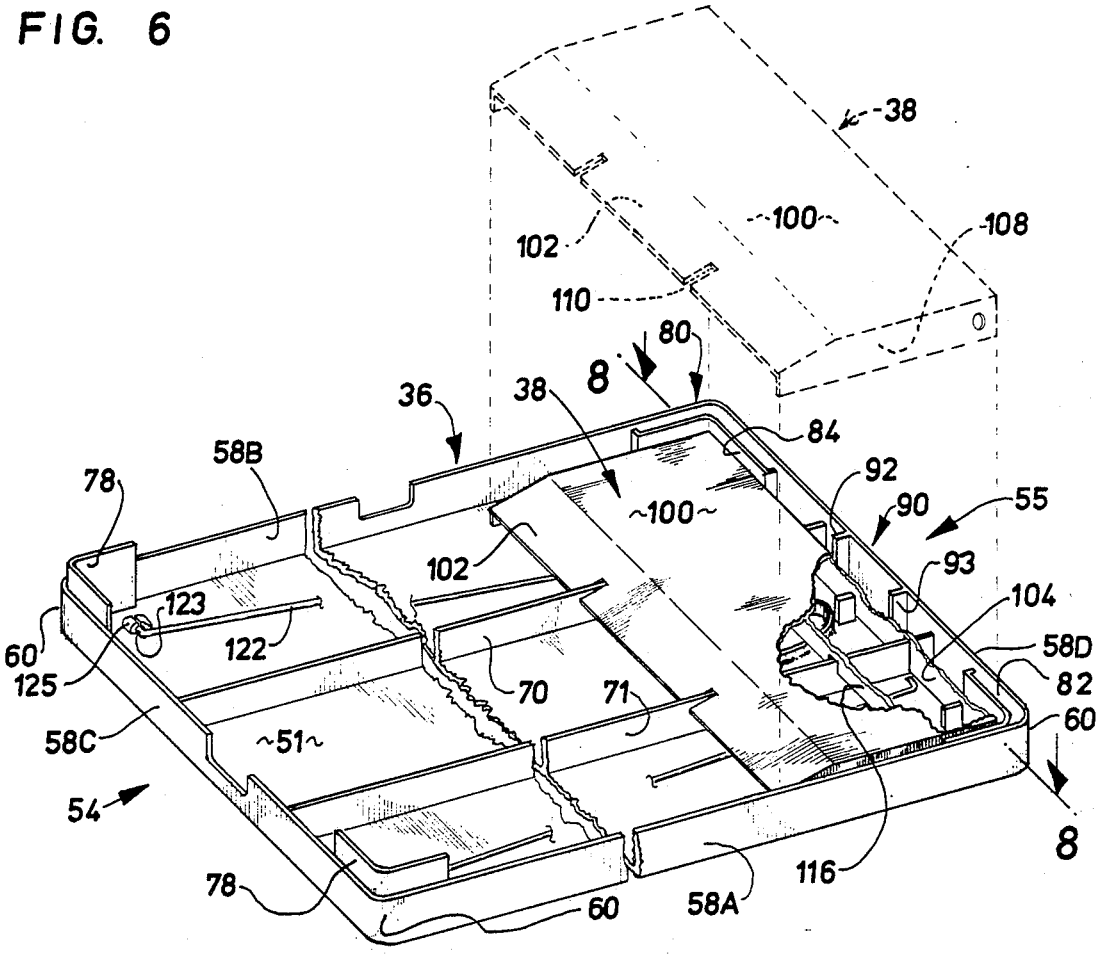
FIG. 6 is a fragmentary isometric view showing the underside of an inclined playing board assembly, with the elevator shown in dashed lines to illustrate a moved position.

The board end which will be in contact with ground 28 during play has been generally designated by the reference numeral 54, while the end normally disposed in the elevated disposition when the game is in play has be generally designated by the reference number 55 (FIG. 6). The elevated end 55 shall also be referred to as the apertured end, for it is preferred to dispose the aperture 40 relatively high up as in FIG. 1. Preferably the diameter of hole 40 is one-fourth the width of the board surface 41 or 51. Approximately eighty percent of the length of the board is disposed beneath the center of hole 40.

The generally rectangular playing board surface 51 is bounded by a peripheral wall comprising side segments 58A and 58B and end segments 58C and 58D. These wall segments arcuately meet in gradually rounded corners 60. The height of the peripheral wall essentially corresponds to the thickness of a single playing board. When the playing boards are coupled together as shown in FIGS. 2 or 3, the net thickness of the apparatus is thus approximately twice that of an individual playing board, or of the wall height. As best viewed in FIG. 5, notches 59 are preferably formed in the peripheral wall sections 58B and 58C, so that in the transportable mode (FIG. 2) or the display convenient mode (FIG. 3) convenient recessed carrying handles 53 result.

Figure 7:
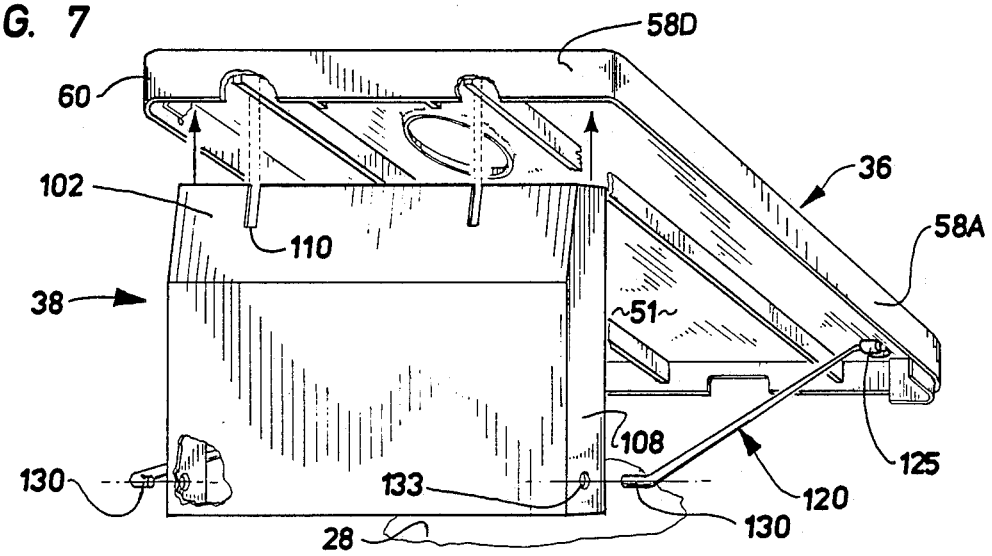
FIG. 7 is a fragmentary, rear perspective view showing how each target assembly is deployed for use.
Figure 8:
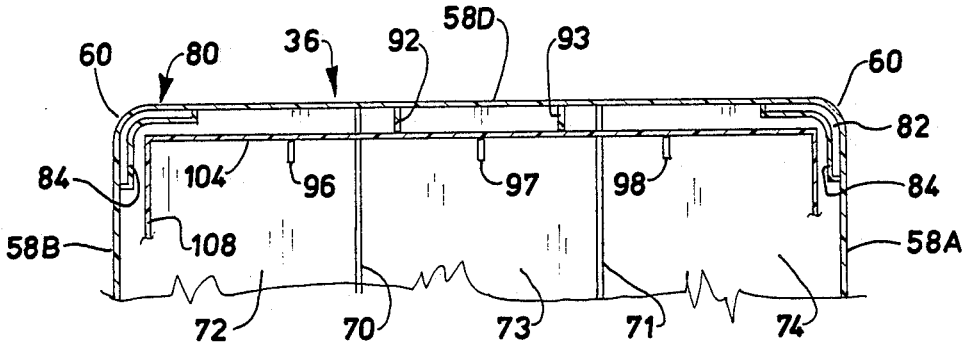
FIG. 8 is a fragmentary sectional view taken generally along line 8—8 of FIG. 6 in the direction of the arrows; and, FIG. 9 is a fragmentary side elevational view of a single target board disposed in the playing mode.

The underside of the playing board, as best viewed in FIGS. 6–8 comprises a pair of flat, integral, longitudinally extending reinforcing ribs 70, 71. As best viewed in FIG. 8, these equally spaced apart ribs divide the underside of the board into three general regions, designated respectively by the reference numerals 72, 73 and 74. Ribs 70 and 71 extend all the way from the peripheral wall segment 58C to opposite segment 58D, all the way between board ends 54 and 55. While these ribs reinforce the board, they permit a degree of resilience.

With combined reference to FIGS. 6–9, the underside of each playing board includes a pair of generally resilient, somewhat curved, generally L-shaped outwardly projecting legs 78. As best viewed in FIGS. 5 and 6, each of these legs is gently curved somewhat and is thus somewhat parallel with corners 60. These legs project approximately three quarters of the width of the peripheral wall. In the play mode these legs engage the ground 28 (FIG. 9) and elevate end 54 a distance 57 of approximately 2.5 inches above ground. They also tend to brace the target assembly against translational vector displacements from bag impact.

Figure 5:
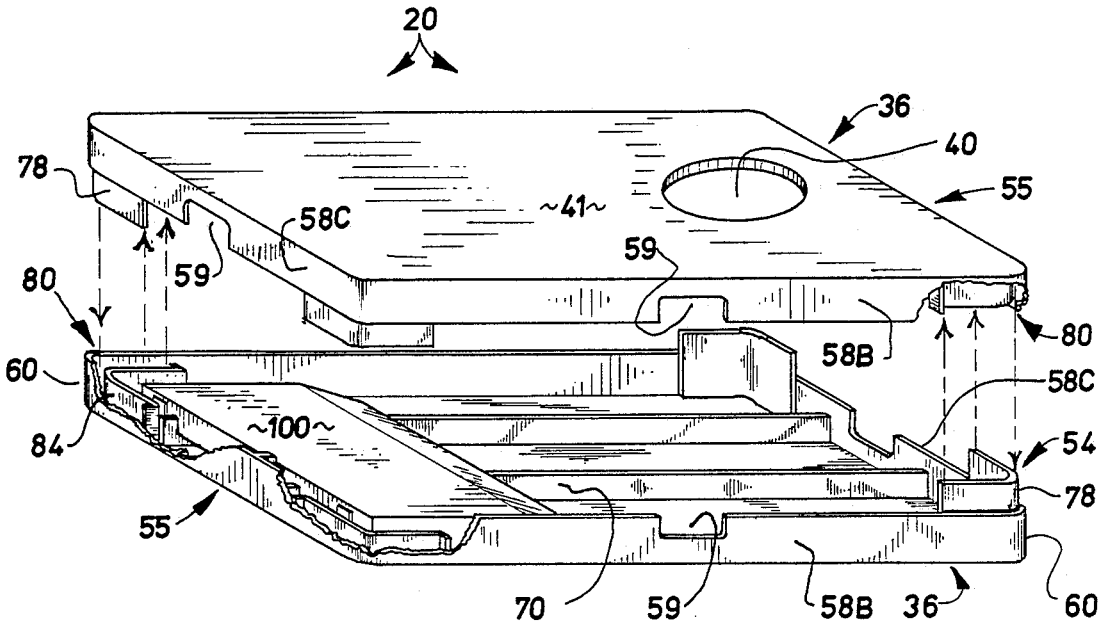
FIG. 5 is a view similar to FIG. 4, but showing the target assemblies in their generally planar orientation immediately prior to coupling together.

Importantly, the legs fit into matching sockets, generally designated by the reference numeral 80, which are defined in the opposite end of the playing board. The legs are mated to the sockets to dispose the apparatus in either the transportation or display modes. Thus as best seen in FIG. 5, the boards may be pressed together so that leg 78s on one end are pressed into socket 80 defined in the opposite end. With primary attention directed to FIG. 8, each socket 80 comprises a hollow, generally L-shaped channel-like void 82 defined between corner 60 and a similarly profiled, generally L-shaped retainer wall 84. Walls 84 are spaced apart from and generally parallel with the corner 60 of the board periphery. Thus the void 82 is shaped to frictionally receive the legs 78 which may be press-fitted therein to join the boards together.

As best viewed in FIGS. 6 and 8, the interior of each playing board also comprises snap-fit tab means generally designated by the reference numeral 90. The snap fit tab means comprise a pair of spaced apart, rigid tabs 92, 93 integral with peripheral wall portion 58D, and a trio of aligned and spaced apart tabs 96, 97, 98. As will hereinafter be explained in detail, the planar edge portion of the elevator tray 38 is press-fitted between these tabs to force the elevator tray to maintain the apparatus in the play position.

Figure 9:
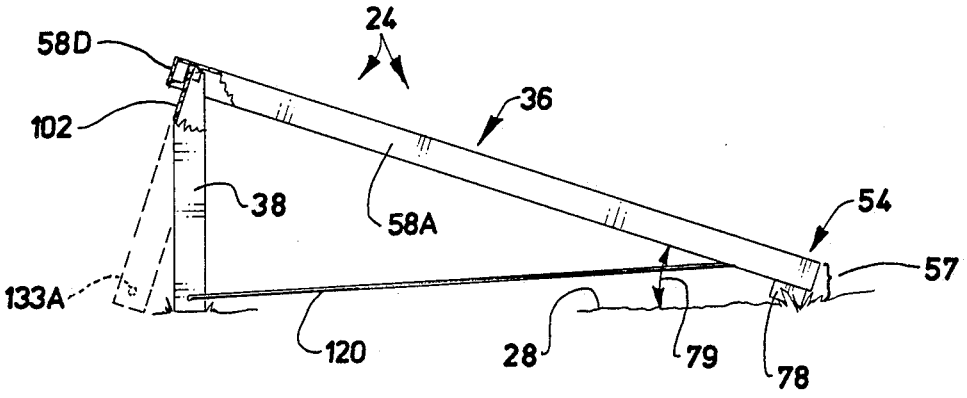

The portable bag tossing game comprises a pair of target assemblies, and thus a pair of identical elevator tray assemblies 38 are required. As best viewed in FIG. 4, these elevator tray assemblies are somewhat rectangular, and they may be disposed in the transportation mode within the underside of the playing boards. The preferred width to length ratio of these trays is two to one. As seen in FIGS. 7 and 9, for example, they may be frictionally removed from the underside of the playing board when the game is to be played, and be disposed as in FIGS. 7 and 9 to elevate the apertured end of the playing board for play of the game. Each elevator tray is generally rectangular, comprising an outer cover portion 100 having an inclined leading edge 102, a rear 104, and a pair of sides 108. A pair of spaced apart notches 110 are defined in the inclined leading edge 102. A pair of similar notches 112 are defined in the back 104. As best viewed in FIG. 4, the underside of the elevator tray has been generally designated by the reference numeral 114. It includes a transverse reinforcing rib 116 generally parallel and spaced apart with respect to back 104, which includes a pair of notches 118 aligned with notches 110 and 112.

As seen in FIGS. 6 and 8 it will be appreciated that the elevator tray may be snap-fitted into the interior or underside of the playing board. When this occurs, tray rear wall 104 will be tensioned by snap fit means tabs 96–98 on one side and by snap fit means tabs 92, 93 on its other side. At the same time, tray notches 110, 112 and 118 (FIG. 4) Will be penetrated by reinforcement ribs 70, 71. The elevator tray will be tightly maintained in the disposition shown in FIG. 6 by frictional contact with the snap fit tab means 90, previously discussed. However, the elevator tray may be yieldably removed from the underside of the playing board, and disposed for playing as indicated in FIG. 7. In this configuration slots 110 will clear the reinforcement ribs 70, 71, and the inclined edge 102 will be captivated within the snap fit means 90 previously discussed.

It is preferred that a pair of rigid braces, each generally designated by the reference numeral 120, be included to complete the preferred right triangular orientation of each playing board in use. Each brace 120 comprises a rigid, elongated stiffener rod 122 which include captivated ends 123 received within suitable bosses 125 defined upon undersurface 51 of the playing board. The opposite rod ends 130 are adapted to be selectively coupled to elevator tray apertures 133. When remote rod ends 130 (FIG. 7) are popped into the elevator tray apertures 133, the elevator tray will be strengthened. And, because of the chosen length of the brace 120 a substantially right triangular disposition results. However, if the leading edge 102 of the elevator tray means were not inclined, the elevator tray would occupy that position indicated generally by dashed lines in FIG. 9. It is apparent from inspection that the brace 120 would not reach the orifice 133A depicted in FIG. 9, so that by inclining edge 102 of the elevator tray the brace 120 can be housed within and adjacent the undersurface of the playing board, while being immediately deflectable to the reinforcing play position of FIG. 9. Also, by virtue of the inclination of the leading edge 102 of elevator tray 38, an overall orientation substantially that of a right triangle results.

Figure 4:
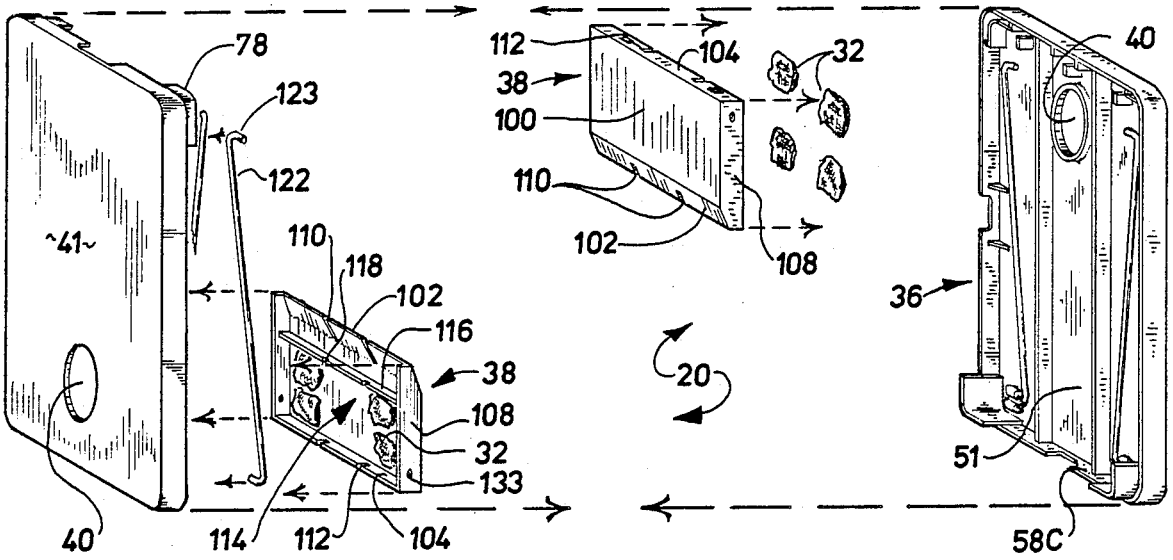
FIG. 4 is an exploded isometric view showing how the separate target assemblies can be coupled together to place the game in the transportation mode.

As best viewed in FIG. 4, it is preferred that the various bags or projectiles 32 may be stored within the elevator tray when it is snap-fitted to the underside of the playing board. As best seen in FIG. 6, each stiffener rod 122 will abut the underside 51 of the board, where it will be retained by physical contact with tray 38. Since the braces and bags are so restrained, unwanted rattling noises will be suppressed when the game is transported.

In the best mode the thickness of the playing board surfaces and tabs, peripheral wall and the like is 0.125 inches. It is preferred that the width to length ratio of the playing board is 2 to 3. The elevator trays are also molded from ⅛" polystyrene, and their width to length ration is approximately 2 to 1 in the best mode. It is also preferred that a slope of approximately fifteen degrees be utilized during play. Thus the angle of tilt 79 in FIG. 9 is approximately 15 degrees. It is also preferred that approximately eight bags are used, each weighed with approximately eight ounces.

RULES OF PLAY

In the best mode the game is played by either two players or two teams of players. Where teams are involved, one member of each team will be placed at either end of the playing ground. In most cases it has proven best to have the targets disposed approximately twenty feet apart. Team partners face each other from opposite targets and play can commence at either end. Each team plays with a set of four bags, and in the case of teams, opponents alternate tossing until all of the bags have been tossed. Scoring is determined according to preestablished rules, and the scoring team tosses first in the next round.

It is preferred in scoring that the game lasts until twenty-one points have been scored. Three points are given for the penetration of the hole in the target by a bag. One point is given when a bag remains on the board after tossing. Total points awarded after a play are determined by subtracting the number of points scored by the lesser scoring team from the number of points scored by the greater. For example, if during one play team one lands one bag in the hole it receives a preliminary three points. However, if team two places two bags on the board, it achieves two points. The lesser score of two points is subtracted from the higher three point score to give a first round score for team one of one point.

Bags pushed into the hole by an opponents toss count in point generation. However, if a bag is knocked off the board by an opponent, then no score is awarded for the bag falling off. No score is awarded for a bag tossed out of turn, or for a bag which although partially on the board, is touching the ground. There is no score awarded for a bag tossed by a player who foot fouls. Foot fouling is generally defined as throwing when ones feet cross line 39 (FIG. 1) established by the rear of the elevator tray 38. Thus player 30 in FIG. 1 is actually foot fouling.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A portable tossing game for one or more players, said game comprising:

first and second target assemblies adapted to either be coupled to one another to dispose said tossing game in a transportable mode or to be separated and detached from one another to dispose said game in a playing mode;

a plurality of projectiles adapted to be tossed by players toward said target assemblies; and, each of said target assemblies comprising:

a resilient playing board comprising an aperture penetrable by said projectiles, leg means projecting away from said board, and socket means defined in each playing board for mating with and receiving leg means emanating from the other playing board when said boards are fitted together; and, elevator tray means associated with each playing board adapted to be selectively coupled thereto in either:

(i) a storage orientation snugly nested thereto; or, (ii) an operational orientation elevating one end of said playing board.

2. The tossing game as defined in claim 1 wherein said first and second target assemblies are structurally identical with one another.

3. The game as defined in claim 1 wherein each playing board is generally rectangular and comprises an external target surface, an internal surface, a pair of ends, and a peripheral wall bounding said internal surface, said peripheral wall having a height.

4. The tossing game as defined in claim 3 wherein said peripheral wall comprises a plurality of corners, said leg means emanates from one end of said playing board spaced apart from corners at that end, and said socket means is defined adjacent corners at the opposite end of said playing board.

5. The tossing game as defined in claim 4 including a pair of longitudinally extending, spaced apart reinforcement ribs extending along said internal surface between opposite ends of said playing board.

6. The tossing game as defined in claim 1 including brace means adapted to be extended between said playing board and said elevator tray means when said game is disposed in said playing mode for reinforcing said playing board.

7. The tossing game as defined in claim 6 wherein said playing board inner surface comprises boss means for receiving one end of said brace means, and said brace means comprises an aperture for selectively receiving an opposite end of said brace means.

8. The tossing game as defined in claim 5 wherein said elevator tray means is adapted to be snugly fitted to said playing board inner surface when said game is disposed in said transportable mode.

9. The game as defined in claim 8 wherein said elevator tray means comprises clearance slots for receiving said longitudinal reinforcement ribs when fitted to said playing board.

10. The game as defined in claim 5 wherein said playing board comprises snap fit tab means associated with said inner surface for frictionally, wedgably receiving and retaining at least a portion of said elevator tray means when fitted to said playing board in said playing mode.

11. The tossing game as defined in claim 10 including means adapted to be extended between said playing board and said elevator tray means when said game is disposed in said playing mode for bracing said elevator tray means.

12. The tossing game as defined in claim 11 wherein said elevator tray means comprises an inclined end adapted to be coupled to said snap fit tab means whereby to reduce the required length of said brace means, so that when said game is thereafter disposed in said transportable mode, said brace means will fit within said playing board surrounded by said peripheral wall.

13. The tossing game as defined in claim 12 wherein said playing board inner surface comprises boss means for receiving one end of said brace means, and said elevator tray means comprises an aperture for selectively receiving an opposite end of said brace means.

14. A portable, modular tossing game for one or more players, said game comprising:

a pair of substantially identical, molded plastic target assemblies adapted to either be coupled to one another to dispose said tossing game in a transportable mode or to be separated and detached from one another to dispose said game in a playing mode, each of said target assemblies comprising:

a resilient, generally rectangular playing board comprising an external target surface, an internal surface, a target aperture, a pair of ends, leg means projecting away from said board, and socket means defined in each playing board for mating with and receiving leg means emanating from the other playing board when said boards are fitted together; and, means associated with each playing board for elevating one end of said playing board to incline same;

a plurality of bags adapted to be tossed by players toward said target assemblies; and, rules for determining points awarded to players in accordance with the resting position of bags.

15. The tossing game as defined in claim 14 wherein each board comprises a peripheral wall bounding said internal surface, said peripheral wall having a height and a plurality of corners, said leg means emanates from one end of said playing board spaced apart from corners at that end, and said socket means is defined adjacent corners at the opposite end of said playing board.

16. The tossing game as defined in claim 15 wherein said elevator tray means is generally rectangular and comprises a length, a width, and a thickness, said thickness being less than said height of said peripheral wall.

17. The tossing game as defined in claim 16 wherein said playing boards comprise a pair of longitudinally extending spaced apart reinforcement ribs extending along said internal surface.

18. The tossing game as defined in claim 16 including brace means adapted to be extended between said playing board and said elevator tray means when said game is disposed in said playing mode for reinforcing said playing board.

19. The tossing game as defined in claim 18 wherein said playing board inner surface comprises boss means for receiving one end of said brace means, and said brace means comprises an aperture for selectively receiving an opposite end of said brace means.

20. The tossing game as defined in claim 16 wherein said elevator tray means is adapted to be snugly fitted to said playing board inner surface when said game is disposed in said transportable mode.

21. The game as defined in claim 20 wherein said elevator tray means comprises clearance slots for receiving said longitudinal reinforcement ribs when fitted to said playing board.

22. The game as defined in claim 21 wherein said playing boards comprise snap fit tab means associated with said inner surface for frictionally, wedgably receiving and retaining at least a portion of said elevator tray means when fitted to said playing board in said playing mode.

23. The tossing game as defined in claim 22 including brace means adapted to be extended between said playing board and said elevator tray means when said game is disposed in said playing mode.

24. The tossing game as defined in claim 23 wherein said elevator tray means comprises an inclined end adapted to be fitted to said snap fit tab means whereby to reduce the required length of said brace means, so that when said game is thereafter disposed in said transportable mode, said brace means will fit within said playing board surrounded by said peripheral wall.

25. The tossing game as defined in claim 24 wherein said playing board inner surface comprises boss means for receiving one end of said brace means, and said elevator tray means comprises an aperture for selectively receiving an opposite end of said brace means.

26. A portable, modular tossing game for one or more players, said game comprising:

a pair of substantially identical, molded plastic target assemblies adapted to either be coupled to one another to dispose said tossing game in a transportable mode or to be separated and detached from one another to dispose said game in a playing mode, each of said target assemblies comprising:

a resilient, generally rectangular playing board comprising an external target surface, an internal surface, a target aperture, a pair of ends, leg means projecting away from said board, and socket means defined in each playing board for mating with and receiving leg means emanating from the other playing board when said boards are fitted together; and, elevator tray means associated with each target assembly for inclining one end of said playing board; and, brace means adapted to be extended between said playing board and said elevator tray means when said game is disposed in said playing mode;

a plurality of bags adapted to be tossed by players toward said target assemblies; and, rules for determining points awarded to players in accordance with the resting position of bags after a round of play.

27. The tossing game as defined in claim 26 wherein each playing board comprises a width, a length, and an integral peripheral wall bounding said internal surface, said peripheral wall having a height and a plurality of corners, said leg means emanates from one end of said playing board spaced apart from corners at that end, and said socket means is defined adjacent corners at the opposite end of said playing board.

28. The tossing game as defined in claim 27 wherein said elevator tray means is generally rectangular and comprises a length, a width, and a thickness, said thickness being less than said height of said peripheral wall, and said elevator tray means width being approximately two thirds of said elevator tray means length.

29. The tossing game as defined in claim 27 wherein said playing boards comprise a pair of longitudinally extending spaced apart reinforcement ribs extending along said internal surface, said playing board inner surface comprises boss means for receiving one end of said brace means, and said brace means comprises an aperture for selectively receiving an opposite end of said brace means.

30. The tossing game as defined in claim 29 wherein said elevator tray means is adapted to be snugly fitted to said playing board inner surface when said game is disposed in said transportable mode, and comprises clearance slots for receiving said longitudinal reinforcement ribs when fitted to said playing board.

31. The game as defined in claim 30 wherein said playing boards comprise snap fit tab means associated with said inner surface for frictionally, wedgably receiving and retaining at least a portion of said elevator tray means when fitted to said playing board in said playing mode, said elevator tray means comprising an inclined end adapted to be fitted to said snap fit tab means whereby to reduce the required length of said brace means, so that when said game is thereafter disposed in said transportable mode, said brace means will fit within said playing board surrounded by said peripheral wall.

* * * * *